US005244070A

United States Patent [19]

Carmen et al.

[11] Patent Number: 5,244,070

[45] Date of Patent: Sep. 14, 1993

[54] DUAL COIL COIN SENSING APPARATUS

[75] Inventors: Ralph H. Carmen, Lebanon, N.J.; James M. Rodgers, Harrison, Ark.

[73] Assignee: Duncan Industries Parking Control Systems Corp., Harrison, Ark.

[21] Appl. No.: 845,635

[22] Filed: Mar. 4, 1992

[51] Int. Cl.[5] ..... G07D 5/08

[52] U.S. Cl. ..... 194/319

[58] Field of Search ..... 194/317, 318, 319

[56] References Cited

U.S. PATENT DOCUMENTS

| | | | |
|---|---|---|---|
| 2,540,063 | 1/1951 | Victoreen . | |
| 2,642,974 | 6/1953 | Ogle . | |
| 3,059,749 | 10/1962 | Zinke . | |
| 3,242,932 | 3/1966 | Becker . | |
| 3,373,856 | 3/1968 | Kusters et al. . | |
| 3,378,126 | 4/1968 | Kuckens et al. . | |
| 3,587,809 | 6/1971 | Meloni . | |
| 3,682,286 | 8/1972 | Prumm . | |
| 3,738,469 | 6/1973 | Prumm . | |
| 3,796,295 | 3/1974 | Montolivo et al. . | |
| 3,901,368 | 8/1975 | Klinger . | |
| 3,918,564 | 11/1975 | Heiman et al. . | |
| 4,091,908 | 5/1978 | Hayashi et al. . | |
| 4,105,105 | 8/1978 | Braum . | |
| 4,108,296 | 8/1978 | Hayashi et al. . | |
| 4,124,111 | 11/1978 | Hayashi . | |
| 4,128,158 | 12/1978 | Dautremont, Jr. . | |
| 4,151,904 | 5/1979 | Levasseur et al. . | |
| 4,206,775 | 6/1980 | Tanaka . | |
| 4,234,071 | 11/1980 | Le-Hong . | |
| 4,286,704 | 9/1981 | Wood . | |
| 4,323,148 | 4/1982 | Nichimoto et al. . | |
| 4,326,621 | 4/1982 | Davies . | |
| 4,353,453 | 10/1982 | Partin et al. | 194/319 |
| 4,371,073 | 2/1983 | Dubey . | |
| 4,436,196 | 3/1984 | Crisp et al. . | |
| 4,437,558 | 3/1984 | Nicholson et al. . | |
| 4,460,080 | 7/1984 | Howard . | |
| 4,469,213 | 9/1984 | Nicholson et al. . | |
| 4,705,154 | 11/1987 | Masho et al. | 194/319 |
| 4,842,119 | 6/1989 | Abe | 194/317 |

FOREIGN PATENT DOCUMENTS

| | | | |
|---|---|---|---|
| 54739/80 | 6/1983 | Australia . | |
| 3522229 | 1/1987 | Fed. Rep. of Germany | 194/319 |
| 56-11182 | 3/1981 | Japan . | |
| 58-6985 | 2/1983 | Japan . | |
| 58-30632 | 6/1983 | Japan . | |
| 1401363 | 7/1975 | United Kingdom . | |
| 2020469 | 11/1979 | United Kingdom . | |

*Primary Examiner*—F. J. Bartuska

*Attorney, Agent, or Firm*—James P. Ryther

[57] ABSTRACT

An apparatus for sensing coins is disclosed which is capable of distinguishing between valid and non-valid coins as well as between the different denominations of coins. The apparatus is useful for application in coin-operated parking meters as well as other coin-operated machines. The apparatus makes use of a twin-coil sensor which enables it to distinguish between small coins with high metal content and large coins with low metal content.

30 Claims, 3 Drawing Sheets

DUAL COIL COIN SENSING APPARATUS

BACKGROUND OF THE INVENTION

The present invention relates to methods and devices for sensing the presence and characteristics of coins as part of, for example, a coin-operated parking meter. Primary objectives of such devices, are to discriminate between valid coins and counterfeit ones or other coin-like objects, as well as between different denominations of valid coins.

A common coin sensing method employed by previous devices is the use of a sensor coil whose impedance is changed by the nearby presence of a metal object such as a coin. One type of discrimination circuit using such a sensor coil is a bridge circuit which includes standard impedance elements in addition to the coil. Passage of the coin near the coil then causes the balance point to change. Another type of detection circuit uses the coil as part of an oscillator circuit. The presence of a coin near the coil causes the frequency at which the oscillator resonates to shift. By measuring the frequency shift it is possible to detect the presence of a coin. Furthermore, the magnitude of the frequency shift will depend on such things as the size and material content (e.g., iron, copper, or silver etc.) of the coin. Therefore, standard frequency shift "signatures" for valid coins can be ascertained allowing the circuitry to discriminate between denominations of valid coins and between valid coins and other objects.

A problem with sensor coils of the type described above, however, is that the change in impedance (and frequency shift) is dependent upon both the total metal mass of the coin and the particular material out of which the coin is made. This means the same impedance change can be caused by either a large, low response material (e.g. copper) coin or a small, high response material (e.g. iron) coin.

Previous sensor coils may also require a large amount of power in order to properly discriminate between coins. This can be a particular problem in applications where the coin sensing device does not have access to an external power source.

SUMMARY OF THE INVENTION

The present invention is a coin sensor which employs sensor coils electrically connected in series and as part of an oscillator circuit. The coils are physically positioned so that a coin to be detected passes sequentially through the two coils. The coils are spaced apart at approximately the diameter of the largest coin accepted as valid by the sensor (e.g., about 0.96 inches for a U.S. quarter). A coin passing through the first coil changes the impedance of the coil so that the frequency of the oscillator output increases. The resulting frequency shift will be maximum when the coin is at the center of the coil. As the coin exits the first coil and enters the region between the two coils, the oscillator frequency decreases and then increases again as the coin passes through the second coil. Thus the coin passage produces two peaks of maximum frequency shift separated by a local minimum. The frequency at the local minimum will be very near the steady. state value for a small coin since the coin will have a very small effect on either coil when in the region between the two coils. A larger coin with the same material content, on the other hand, will still affect both coils to some extent so that the oscillator frequency at the local minimum will be greater than in the case of a small coin. The present invention therefore allows discrimination between large, low response material coins and small, high response material coins. Also, since the coin passes through the coils where the magnetic field is strongest, more sensitivity is obtained for a given amount of power.

It is therefore an object of the present invention to be capable of distinguishing between large and small coins which would have an identical response for a single coil sensor. It is a further object for the device to provide a coin sensing device with low power consumption. Other objects, features, and advantages of the invention will become evident in light of the following detailed description considered in conjunction with the referenced drawings of a preferred exemplary embodiment according to the present invention.

DETAILED DESCRIPTION OF THE INVENTION

Figure 1:
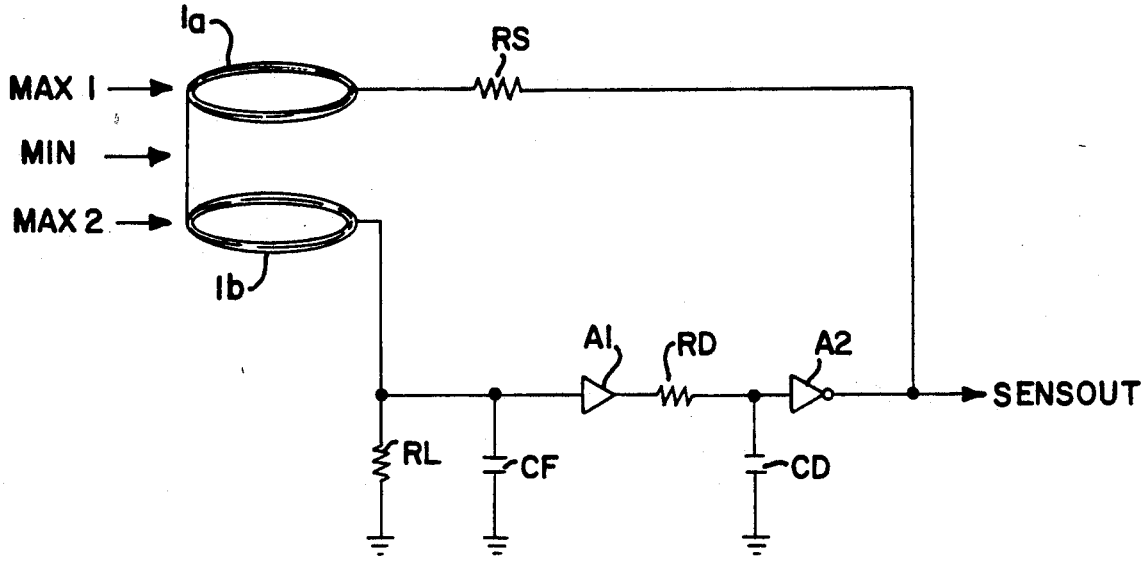
FIG. 1 is a schematic of oscillator circuit showing the arrangement of the dual sensor coils in accordance with the present invention.

FIG. 1 is a schematic showing the physical arrangement of the two sensor coils 1*a* and 1*b* and their incorporation into an exemplary oscillator circuit. The coils 1*a–b* are designed to be placed in the coin's path so that the coin will pass sequentially through each coil. It is expected that a typical coin-operated meter employing the present invention will have the two coils 1*a–b* mounted within a coin chute so that an inserted coin will fall through both coils.

Figure 4:
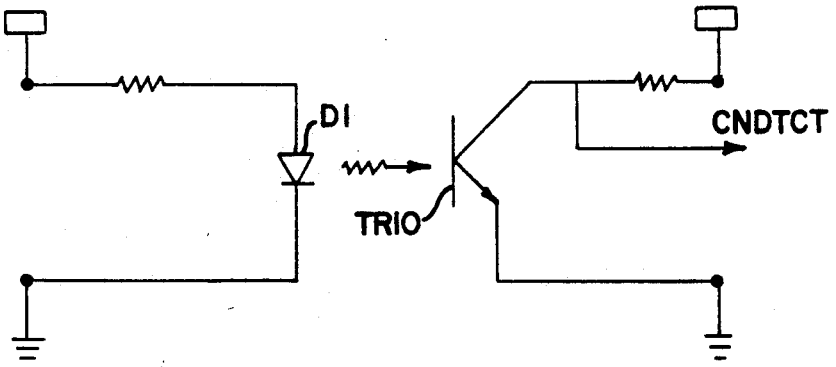
FIG. 4 is a schematic of an exemplary optical coin detector.

In order for the monitoring circuitry described below to know when a coin is about to enter the sensor coils, some type of coin detector should be placed in the coin path just in front of the sensor coils. FIG. 4 shows in schematic form an optical coin detector comprising a light emitting diode D1 and a phototransistor TR 10. When a coin or other object blocks the light emitted from diode D1 from reaching phototransistor TR1, the latter turns off which provides a coin detect signal CNDTCT for use by the monitoring circuitry. In a preferred embodiment, the diode D1 is pulsed periodically rather than having a constant voltage applied in order to conserve power. The monitoring circuitry thus looks for the assertion of CNDTCT after a pulse has been applied to diode D1.

The oscillator circuitry shown in FIG. 1 comprises the sensor coils 1*a–b*, capacitor $C_F$, capacitor $C_D$, resistor $R_D$, high gain non inverting amplifier A1, and high gain inverting amplifier A2. $R_S$ and $R_L$ are included in FIG. 1 to represent series losses in the coil and parasitic losses, respectively. The sensor coils are electrically connected in series so as to provide a feedback path around the cascaded amplifiers A1 and A2. Because amplifier A2 is inverting, the signal fed back through the sensor coils is phase shifted 180°. Alternative embodiments may employ any number of cascaded amplifiers as long as there is an odd number of inversions to provide the 180° phase shift. The result is an oscillator circuit which oscillates at a certain resonant frequency depending on the values of L and $C_F$ where L is the total inductance of the sensor coils. The resistor $R_D$ and capacitor $C_D$ are included to stabilize the amplifier delay over the intended operating temperature range. It has been found that temperature stability is also enhanced by potting the coils 1*a-b* with a suitable (and preferably low loss, e.g., non-carbon based) potting compound. Using temperature stable capacitors and a very temperature stable resistor ($R_D$) also enhances stability over the operating temperature range.

In one specific embodiment, the following component values were used:

$C_F$—0.0022 μF
$C_D$—220 pF
$R_D$—400 ohms
L—2400 uH where L is the inductance of the sensor coils 1*a* and 1*b*. It has been found experimentally that it is preferable for the component values to be chosen such that the circuit oscillates at a frequency of between 100 KHz and 200 KHz. The reason for this is that the depth of penetration of the magnetic field produced by the sensor coils 1*a* and 1*b* into a coin at these frequencies is about 0.5 millimeters which is the approximate thickness of the cladding on multilayer coins such as the U.S. quarter. This allows the operation of the sensing device (as described below) to better distinguish between bulk and multilayer coins.

The basic principle of operation is as follows. Referring to FIG. 1, the resistor labeled $R_L$ is intended to represent losses introduced to the coil sensor by insertion of a coin into the coil core. Those losses generally result from eddy currents induced in the coin. With no coin in the coil, the value of $R_L$ is effectively infinite (no losses) and the effective value of $R_L$ decreases with the insertion of ever more lossy coins into the coil core. The decrease in the effective value of $R_L$ causes an increase in sensor operating frequency in accord with the following discussion.

From basic electrical engineering principles, the expression for the input voltage to amplifier $A_1$ given a sinusoidal output from amplifier $A_2$ at radian frequency w is:

$$Vin_1 = Vout_2 * (1/1 + R_S/R_L - w^2 LC_F + jwL/R_L + jwC_F R_S))$$

where $R_L$ represents the losses due to the inserted coin and $R_S$ represents the series resistance of the coil with inductance L. The phase angle between the input and output is then:

$$\text{Arctan}\,(-(wC_F R_S R_L + wL)/(R_L + R_S - w^2 LC_F R_L).$$

Referring to the temperature stable components $R_D$ and $C_D$ in FIG. 1, the combination of those components closely approximates a fixed delay D set by the time constant of $C_D * R_D$ seconds. At radian frequency w, a fixed delay D is equivalent to a phase angle of −w*D radians. The inverting amplifier $A_2$ adds an additional phase angle of −Pi radians. A basic assumption of the sensor operation is that the losses from $R_S$ and $R_L$ can be kept small so that phase is the dominant factor in determining the loop oscillation frequency. This being so, the total phase shift around the loop will be close to −2Pi radians, so the governing equation for the phase around the loop is:

$$\text{Arctan}\,(-(wC_F R_L R_S + wL)/(R_L + R_S - w^2 L C_F R_L)) - \text{wD} - \text{Pi} = -2\text{Pi}$$

or:

$$-(\text{w}C_F R_S R_L + wL)/(R_L + R_S - w^2 LC_F R_L) = \text{Tan}\,(wD - Pi).$$

Since the tangent function repeats every Pi radians:

$$-(wC_F R_S R_L + wL)/(R_S + R_L - w^2 LC_F R_L) = \text{Tan}\,(wD).$$

In practice, the phase angle wD is kept very small so the tangent is closely approximated by the angle and the approximation becomes:

$$-(wC_F R_S R_L + wL)/(R_S + R_L - w^2 LC_F R_L) = wD$$

or:

$$(C_F R_L R_S + wL)/(\text{R}_L + R_S - w^2 LC_F R_L) + wD = 0.$$

Simplification and solving for the operating frequency w yields:

$$w = ((1 + R_S/R_L)/LC_F + 1/C_F DR_L + R_S/LD)^{\frac{1}{2}}.$$

In practice $R_S$ is kept very small compared to $R_L$ so further simplification yields an approximation of the operating frequency w as:

$$w = (1/LC_F + 1/C_F DR_L + R_S/LD)^{\frac{1}{2}}.$$

Thus, with no coin in the sensor, $R_L$ is effectively infinite and the operating frequency is dependent on L, $C_F$, and D, which are nearly constant over the operating temperature range by design, and on $R_S$ which is a function only of temperature and the temperature characteristics of the coil material (copper) which is known. Hence, under the condition of no coin in the sensor, the temperature can be inferred from the operating frequency, which will allow the sensor control microprocessor to perform sensor parametric temperature compensation.

Figure 2:
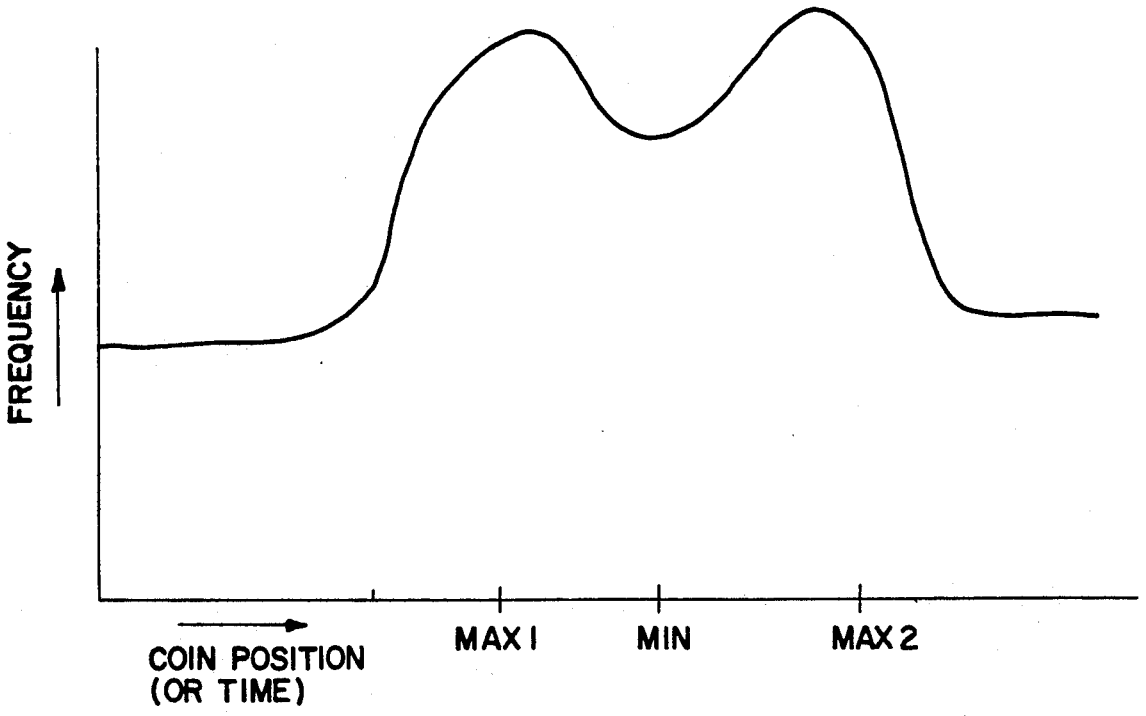
FIG. 2 shows an exemplary frequency signature.

As a coin enters the sensor, eddy current losses reduce the effective value of $R_L$ and cause an increase in the sensor operating frequency which is observed at the sensor output SENSOUT. A coin descending through the sensor coils will cause the frequency of SENSOUT to increase to a maximum when the coin is within coil 1*a*, decrease to a local minimum when the coin is between the coils, and increase to a maximum again as the coin passes through coil 1*b*. These positions are indicated in FIG. 2 by the labels $MAX_1$, MIN, and $MAX_2$, respectively. Thus, by measuring the frequency of SENSOUT as the coin passes through the sensor coils, frequency values for the positions $MAX_1$, MIN, and $MAX_2$ may be ascertained. These three frequency values constitute a signature which may then be compared with standard values stored in a table to determine if the coin is valid and, if so, its denomination. FIG. 2 shows an exemplary signature where oscillator frequency is plotted versus coin position (equivalent to time).

Next, the monitoring circuitry will be described with reference to FIG. 3. The monitoring circuitry basically comprises two counters, a coil counter and a reference counter. The reference counter is driven by a crystal oscillator at a fixed frequency while the coil counter is driven by the SENSOUT signal from the sensor oscillator 15. After initializing the two counters, the operation of each is triggered by the SENSOUT signal. After the coil counter has reached a predetermined value, the reference counter is stopped and its contents read. The reference counter contents are then inversely proportional to the frequency of SENSOUT.

The operation of the monitoring circuitry is controlled by an appropriately programmed microcomputer MC1. The computer MC1 has in its memory a table of standard frequency signatures of valid coins to determine if the sensor readings represent a valid coin. The operation begins as a coin is sensed by the optical coin detector shown in FIG. 4 to result in the assertion of the signal CNDTCT. This signal is monitored by computer MC1 and, when its assertion follows the application of a pulse to diode D1, indicates that a coin is about to enter the sensor coils 1*a* and 1*b*. The oscillator circuitry is normally held in a low-power standby state. The monitoring circuitry is designed so that upon the assertion of CNDTCT, the computer MC1 undertakes certain startup operations for the monitoring circuitry such as turning on the crystal oscillator 25 and engaging the power supply so that the sensor oscillator 15 begins to operate. After stabilization of the crystal and sensor oscillators, the computer MC1 asserts the signal CLSENSOR which clears the coil counter HC393. CLSENSOR also passes through XOR gate G13 to clear the count synchronizing latch LCH1 and load all ones into 4-bit reference counter HC191. The microcomputer at this time also loads all ones into an internal 16-bit reference counter which is regarded by the computer's programming as cascaded with 4-bit counter HC191. The internal 16-bit counter and 4-bit counter HC191 together thus form a 20-bit reference counter.

After SENSOUT from the sensor oscillator has gone through one cycle, the sensor ready latch LCH2 is clocked to the reset state by the least significant bit (QA1) of the coil counter HC393. Resetting latch LCH2 drives its output signal SENSORDY low which then enables the reference counter HC191 to start counting down, driven by crystal oscillator 25 after passing through a frequency doubling circuit comprising gates G10 and G11. In a preferred embodiment, the frequency of the crystal oscillator 25 is on the order of 4 MHz so that counter CN91 is driven at 8 MHZ. The 4-bit output of the reference counter CN91 (50, 51, 52, and 53) is received by the computer MC1. The internal 16-bit reference counter is decremented by the computer MC1 on each rising edge of the S3 bit (i.e., when counter HC191 underflows) so as to effect the cascade between the two counters. On the 256th incrementing of the coil counter HC393, the count synchronizing latch LCH1 is clocked to the set state by the 2QD output of coil counter HC393 inverted through XOR gate G14. On the next SENSOUT pulse from the sensor oscillator 15, the least significant bit of coil counter HC93 (QA1) clocks the sensor ready latch LCH2 to the set state which disables further counting of the reference counter CN191. The output SENSORDY of the sensor ready latch LCH2 is monitored by computer MC1 and, when it becomes set, the contents of the reference counter HC191 is ready. The reference counter contents at this time are inversely proportional to the frequency of SENSOUT. By taking sequential readings in this manner after being triggered by a signal from the optical coin detector, two frequency maximums and a local frequency minimum of SENSOUT may be obtained which correspond to the coin being at the positions labeled $MAX_1$, MIN, and $MAX_2$ in FIG. 1. The resulting signature comprising the three frequency values may then be compared with previously stored signatures corresponding to valid coins to determine the validity and denomination of the coin.

Figure 3:
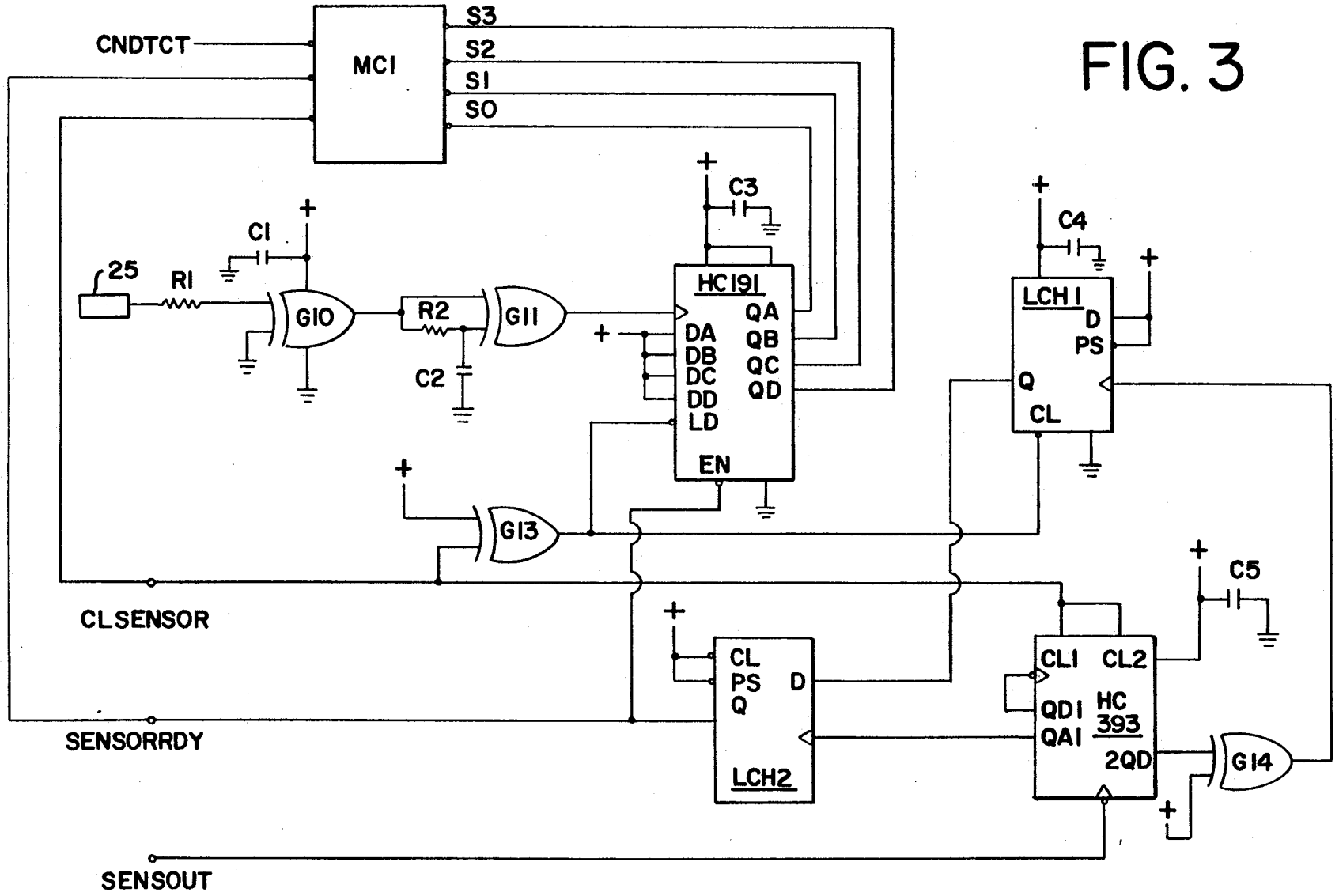
FIG. 3 is an electronic schematic showing the monitoring circuitry for tracking the frequency of the oscillator circuit.

The following table gives the component part numbers and component values for the embodiment described in FIG. 3.

| Reference No. | Description |
|---|---|
| R1 | 4.7K |
| R2 | 4.7K |
| C1 | .1 μF |
| C2 | 10 ρF |
| C3 | .1 μF |
| C4 | .1 μF |
| C5 | .1 μF |
| G10 | Part No. 74HC86 |
| G11 | Part No. 74HC86 |
| G13 | Part No. 74HC86 |
| G14 | Part No. 74HC86 |
| HC191 | Part No. 74HC191 |
| LCH2 | Part No. 74HC74 |
| LCH1 | Part No. 74HC74 |
| HC393 | Part No. 74HC393 |

Figure 5:
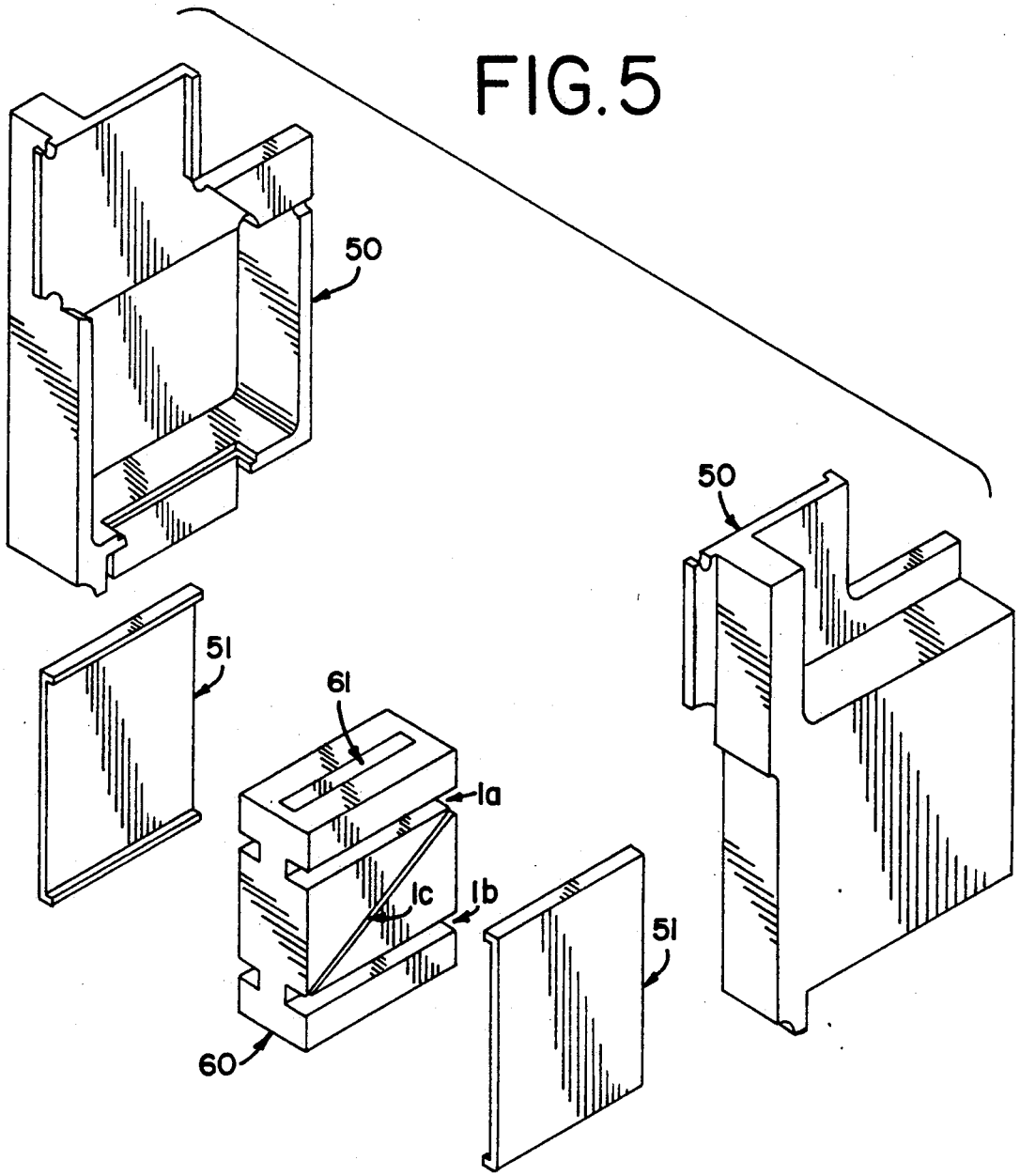
FIG. 5 shows the sensor housing and shield assembly.

In order for the device as just described to give repeatable results for each coin, any ambient losses the sensor coils are subjected to must be relatively constant since those losses contribute to changes in the impedance of the coils and changes in oscillation frequency. Ambient losses may be caused by any metal in fairly close proximity to the coils (a few inches). Thus, in order for the device to function properly in a variety of different environments, it is desirable to shield the sensor coils from nearby lossy materials. In a preferred embodiment, therefore, the sensor coils 1*a–b* are shielded from such materials by a metallic housing. FIG. 5 shows the sensor coils 1*a–b* wrapped around opposite ends of a plastic bobbin 60 and series connected by segment 1C. (The bobbin 60 must be plastic or some other non-lossy material to minimize steady state parasitic losses).

The bobbin 60 has a coin slot 61 so that an inserted coin will pass sequentially through the sensor coils 1*a–b*. With the bobbin and coil assembly placed in the metallic housing 50, the sensor coils will be shielded from nearby materials housing 50, which, in a preferred embodiment is constructed of zinc with a thickness of approximately 0.1 inch. The sensor coils are enclosed as completely as possible and spaced approximately 0.5 inches from the housing in all dimensions. The material of which the housing 50 is made does cause losses that change the operating frequency of the coil system. Those losses are relatively small and fixed for a particular embodiment by the material and distance of the housing from the sensor coils. The coil will therefore operate at a relatively non-varying frequency in the environment intended.

The variations in coil circuit impedance and oscillation frequency due to eddy current losses in nearby external materials can be further reduced by a shield around the sensor coils 1*a–b* that is made of a material with relatively high magnetic permeability and very low eddy current losses at high frequencies. In the preferred embodiment as shown in FIG. 5, the shield 51 is made of a ferrite material with a thickness of 0.050 inch. Enclosing the sensor coils 1*a–b* in a shield of ferrite will direct the majority of the magnetic flux through the shield 51 with virtually no eddy current losses, thus allowing only a small amount of flux to escape through the coin slot openings 61 to interact with nearby lossy materials, including the housing 50. The shield 51 thus provides a very stable base oscillation frequency for the coil regardless of other nearby materials so any significant changes in the oscillation frequency can be utilized to improve the ability of the sensor to identify a coin passing through the assembly.

Although the invention has been described in conjunction with the foregoing specific embodiment, many alternatives, variations, and modifications will be apparent to those of ordinary skill in the art. Those alternatives, variations, and modifications are intended to fall within the scope of the following appended claims.

What is claimed is:

1. A coin sensing apparatus, comprising:

a pair of sensor coils electrically connected in series and physically arranged so that a coin deposited into the apparatus may pass sequentially through each sensor coil and thereby change the impedance of the coil;

a sensor oscillator circuit incorporating the pair of sensor coils which outputs an oscillating sensor signal at a frequency dependent on the impedance of the sensor coils; and, counter means for measuring the frequency of the sensor signal as a coin passes sequentially through the sensor coils to obtain a frequency signature for the coin which can be compared with characteristic frequency signatures of valid coins.

2. The coin sensing apparatus as set forth in claim 1 wherein the sensor coils are spaced apart at approximately the diameter of the largest valid coin to be accepted.

3. The coin sensing apparatus as set forth inc claim 1 wherein the signature comprises a first frequency maximum, a local frequency minimum, and a second frequency maximum of the oscillating sensor signal corresponding to a coin being within one sensor coil, between the sensor coils, and within the other sensor coil, respectively.

4. The coin sensing apparatus as set forth in claim 1 wherein the means for measuring the frequency of the sensor comprises:

a fixed frequency oscillator;

a reference counter driven by the fixed frequency oscillator;

a coil counter driven by the sensor oscillator;

means for enabling the reference and coil counters simultaneously; and, means for stopping both counters when the contents of the coil counter has reached a predetermined value, the contents of the reference counter then being inversely proportional to the frequency of the sensor oscillator.

5. The coin sensing apparatus as set forth in claim 4 wherein the reference counter is enabled by a pulse from the sensor oscillator.

6. The coin sensing apparatus as set forth in claim 5 further comprising a programmed computer for reading the contents of the reference counter and comparing the calculated sensor oscillator frequency signature to a table of standard signatures.

7. The coin sensing apparatus as set forth in claim 6 further comprising a coin detector for signaling the computer when a coin is about to pass through the coils and wherein the computer is programmed to activate the frequency measuring means upon receipt of a signal from the coin detector.

8. The coin apparatus as set forth in claim 7 wherein the coin detector comprises a light emitting diode and a phototransistor positioned so that a deposited coin will block light emitted from the diode from reaching the phototransistor.

9. The coin sensing apparatus as set forth in claim 8 wherein the light emitting diode is periodically pulsed.

10. The coin sensing apparatus as set forth in claim 1 wherein the sensor coils are shielded from external magnetic effects by a metallic housing.

11. The coin sensing apparatus as set forth in claim 10 wherein the sensor coils are spaced approximately 0.5 inches from the housing in all dimensions.

12. The coin sensing apparatus as set forth in claim 10 wherein the housing is constructed of zinc.

13. The coin sensing apparatus as set forth in claim 10 further comprising a ferrite shield around the sensor coils.

14. The coin sensing apparatus as set forth in claim 1 wherein the counter means for measuring the frequency of the sensor signal comprises:

a fixed frequency oscillator;

a reference counter driven by the fixed frequency oscillator;

a coil counter driven by the sensor oscillator; and means for stopping the counters and comparing the contents thereof.

15. The coin sensing apparatus as set forth in claim 14 including means for substantially simultaneously enabling the counters when a coin is deposited, and means for substantially simultaneously stopping the counters.

16. The coin sensing apparatus of claim 1 wherein the series resistance of the coils varies with the ambient temperature whereby the frequency of said oscillating sensor signal varies with the ambient temperature, and wherein said counter means include a coil counter driven by the sensor oscillator, means for recording the frequency of the coil counter when no coin is present, and means for comparing said recorded frequency of the coil counter with the frequency of the sensor coils as a coin passes through whereby temperature compensation can be achieved.

17. The coin sensing apparatus as set forth in claim 16 wherein the means for measuring the frequency of the sensor comprises:

a fixed frequency oscillator;

a reference counter driven by the fixed frequency oscillator;

means for enabling the reference and coil counters simultaneously; and means for stopping both counters when the contents of the coil counter has reached a predetermined value, the contents of the reference counter then being inversely proportional to the frequency of the sensor oscillator.

18. The coin sensing apparatus as set forth in claim 2 wherein the signature for the coin deposited comprises a first frequency maximum, a local frequency minimum, and a second frequency maximum of the oscillating sensor signal corresponding to the coin being within one sensor coil, between the sensor coils, and within the other sensor coil, respectively.

19. The coin sensing apparatus as set forth in claim 2 wherein the means for measuring the frequency of the sensor comprises:

a fixed frequency oscillator;

a reference counter driven by the fixed frequency oscillator;

a coil counter driven by the sensor oscillator;

means for enabling the reference and coil counters simultaneously; and, means for stopping both counters when the contents of the coil counter has reached a predetermined value, the contents of the reference counter then being inversely proportional to the frequency of the sensor oscillator.

20. The coin sensing apparatus as set forth in claim 19 wherein the reference counter is enabled by a pulse from the sensor oscillator.

21. The coin sensing apparatus as set forth in claim 20 further comprising a programmed computer for reading the contents of the reference counter and comparing the calculated sensor oscillator frequency signature to a table of standard signatures.

22. The coin sensing apparatus as set forth in claim 21 further comprising a coin detector for signaling the computer when a coin is about to pass through the coils and wherein the computer is programmed to activate the frequency measuring means upon receipt of a signal from the coin detector.

23. The coin sensing apparatus as set forth in claim 22 wherein the coin detector comprises a light emitting diode and a phototransistor positioned so that a deposited coin will block light emitted from the diode from reaching the phototransistor.

24. The coin sensing apparatus as set forth in claim 23 wherein the light emitting diode is periodically pulsed.

25. The coin sensing apparatus as set forth in claim 2 wherein the sensor coils are shielded from external magnetic effects by a metallic housing.

26. The coin sensing apparatus as set forth in claim 25 wherein the sensor coils are spaced approximately 0.5 inches from the housing in all dimensions.

27. The coin sensing apparatus as set forth in claim 25 wherein the housing is constructed of zinc.

28. The coin sensing apparatus as set forth in claim 25 further comprising a ferrite shield around the sensor coils.

29. The coin sensing apparatus of claim 2 wherein the series resistance of the coils varies with the ambient temperature whereby the frequency of said oscillating sensor signal varies with the ambient temperature, and wherein said counter means include a coil counter driven by the sensor oscillator, means for recording the frequency of the coil counter when no coin is present, and means for comparing said recorded frequency of the coil counter with the frequency of the sensor coils as a coin passes through whereby temperature compensation may be achieved.

30. The coin sensing apparatus as set forth in claim 29 wherein the means for measuring the frequency of the sensor comprises:

a fixed frequency oscillator;

a reference counter driven by the fixed frequency oscillator;

means for enabling the reference and coil counters simultaneously; and means for stopping both counters when the contents of the coil counter has reached a predetermined value, the contents of the reference counter then being inversely proportional to the frequency of the sensor oscillator.

* * * * *